US005782679A

United States Patent [19]

Hunter

[11] Patent Number: 5,782,679

[45] Date of Patent: Jul. 21, 1998

[54] METAL ABRASIVE BELT AND METHOD OF MAKING SAME

[76] Inventor: David T. Hunter, 12 Belmont Ct., Bedford, N.H. 03110

[21] Appl. No.: 717,796

[22] Filed: Sep. 23, 1996

[51] Int. Cl.[6] ..... B24B 21/00

[52] U.S. Cl. ..... 451/296; 451/489; 451/449

[58] Field of Search ..... 451/296, 526, 451/531, 355, 449, 489; 125/21; 83/788; 29/29.11, 29.1

[56] References Cited

U.S. PATENT DOCUMENTS

| | | | |
|---|---|---|---|
| 12,567 | 11/1855 | Case | 451/343 |
| 2,518,448 | 8/1950 | Caston | 451/296 |
| 2,658,258 | 11/1953 | Hawkinson | 407/29.11 |
| 2,784,536 | 3/1957 | Barron | 125/21 |
| 2,924,050 | 2/1960 | Barron | 125/21 |
| 3,099,904 | 8/1963 | Bell | 451/449 |
| 3,448,023 | 6/1969 | Bell | 451/449 |

*Primary Examiner*—Robert A. Rose

*Attorney, Agent, or Firm*—Daniel J. Bourque; Kevin J. Carroll

[57] ABSTRACT

A metal abrasive belt is used to grind, debur, sand, cut, finish or otherwise abrade a workpiece. The metal abrasive belt includes a continuous metal belt and abrasive particles electroplated onto at least a portion of an outer surface of the continuous metal belt. The abrasive particles are electroplated by electrochemically depositing an electroplating matrix, such as a Nickel matrix, in the presence of abrasive particles, such as diamond or Cubic Boron Nitride particles. The abrasive particles can be electroplated to form selected abrasive and non-abrasive regions on the continuous metal member, for example, by masking selected regions of the continuous metal belt. One embodiment of the metal abrasive belt includes one or more perforations extending through the continuous metal belt. The perforations facilitate cooling and allow swarf to pass through the continuous metal belt while abrading a workpiece. The continuous metal belt can also include one or more burrs at an intersection of the perforations and the inner surface of the continuous metal belt that facilitate gripping of the rollers or pulleys about which the belt is driven.

18 Claims, 2 Drawing Sheets

METAL ABRASIVE BELT AND METHOD OF MAKING SAME

FIELD OF THE INVENTION

The present invention relates to abrasive belts and in particular, to a continuous metal belt having abrasive particles electroplated onto at least a portion of a surface thereof.

BACKGROUND OF THE INVENTION

Abrasive belts are commonly used for grinding, deburring, sanding, lapping, cutting, and/or finishing all types of workpieces or products. Abrasive belts are typically formed from a flexible backing material, such as cloth, paper, kevlar, polyfiber and a cloth/paper combination. Abrasive particles, such as aluminum oxide, silicon carbide, and zirconia alumina, are bonded the flexible backing utilizing various methods including resin glue and other adhesives. Other existing abrasive belts include abrasive particles electroplated to an electrically conducting fabric or wire mesh which is then bonded or laminated onto a backing material.

The abrasive belts are driven around one or more pulleys, allowing the abrasive particles to, abrade the surface of the workpiece or product. During the abrasion process, significant heat, grinding residue (also called swarf), and grinding forces are generated, causing wear and damage to the abrasive belts. When the heat and grinding forces cause bonds to break down, the abrasive particles wear or break off of the existing abrasive belts, while occasionally the multiple layers of the abrasive belts come apart. In existing abrasive belts that are connected or bonded with glue/epoxy, excessive wear and damage to the abrasive belts results in ineffective abrading and frequent replacements of the belt. Existing abrasive belts do not provide a feature that effectively facilitates cooling or removal of swarf during an abrasion process.

The existing abrasive belts are also overly flexible, allowing for undesired stretching of the belt on the pulleys. When the stretched belts are loosely held on the pulleys, the belts will not effectively abrade the workpiece surface and may fall off the pulleys entirely. The flexibility of the existing abrasive belts also results in an excessive camber or bow along the width of the belt, which can adversely affect the consistency of the surface finish on the workpiece and the overall precision of the abrasion process.

Accordingly, what is needed is a metal abrasive belt that is sufficiently rigid and durable to resist wear, separation at the joint and other damage and to prevent frequent replacements of the belts. An abrasive belt is also needed that facilitates cooling during the abrasion process and provides for removal of swarf caused by the abrasion process. What is also needed is a metal abrasive belt that is sufficiently rigid to minimize camber and provide a consistent surface finish on a workpiece.

SUMMARY OF THE INVENTION

The present invention features a metal abrasive belt and method of making a metal abrasive belt. The metal abrasive belt comprises a continuous metal belt having an outer surface and an inner surface, and a plurality of abrasive particles electroplated onto at least a portion of the outer surface of the continuous metal belt. One example of the continuous metal belt includes a stainless steel belt which has a thickness in the range of about 0.010" to 0.020", and is laser welded together at its ends.

The preferred embodiment of the metal abrasive belt includes a plurality of abrasive regions and non-abrasive regions on the outer surface of the continuous metal belt. The abrasive regions include the abrasive particles and the non-abrasive regions are devoid of abrasive particles. Abrasive particles preferably include abrasive materials, such as diamond, Cubic Boron Nitride (CBN), ceramic, or other similar abrasive particles. The preferred metal abrasive belt further includes an electroplating matrix, such as a Nickel matrix, bonding the abrasive particles to the continuous metal belt.

According to one embodiment, the continuous metal belt includes one or more perforations extending through the continuous metal belt from the outer surface to the inner surface. The continuous metal belt preferably includes one or more burrs proximate an intersection of the perforation and the inner surface of the continuous metal belt. The perforation engages with at least one pulley on which the continuous metal belt is driven. The one or more perforations are preferably dimensioned to allow swarf from a workpiece to pass through the one or more perforations during the abrasion process. In one embodiment, the abrasive particles are electroplated onto abrasive regions on the outer surface of the continuous metal belt between the plurality of perforations.

The method of making a metal abrasive belt according to the present invention comprises the steps of forming the continuous metal belt and electroplating the abrasive particles onto at least a portion of the outer surface of the continuous metal belt. The step of forming the continuous metal belt preferably includes welding a strip of metal material together, such as by laser welding, to form the continuous metal belt. The step of forming the continuous metal belt further includes forming one or more perforations through the continuous metal belt, such as by punching the continuous metal belt, to form one or more burrs on the continuous metal belt at an intersection of the perforation and inner surface of the continuous metal belt.

The step of electroplating the abrasive particles includes electrochemically depositing an electroplating matrix on at least a portion of the outer surface of the continuous belt in the presence of the abrasive particles. Electrochemically depositing preferably includes coating the outer surface of the continuous metal belt with the abrasive particles suspended in the electroplating matrix, and applying an electric current to the continuous metal belt and electroplating matrix such that the electroplating matrix partially surrounds and bonds the abrasive particles to the continuous metal belt.

According to one method, the step of electroplating the abrasive particles includes electroplating the abrasive particles onto selected regions of the continuous metal belt to form the abrasive regions. This method includes masking selected regions on the outer surface of the continuous metal belt before coating the continuous metal belt such that the electroplating matrix and abrasive particles will not bond to the masked non-abrasive regions thereby forming the non-abrasive regions of the abrasive metal belt.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
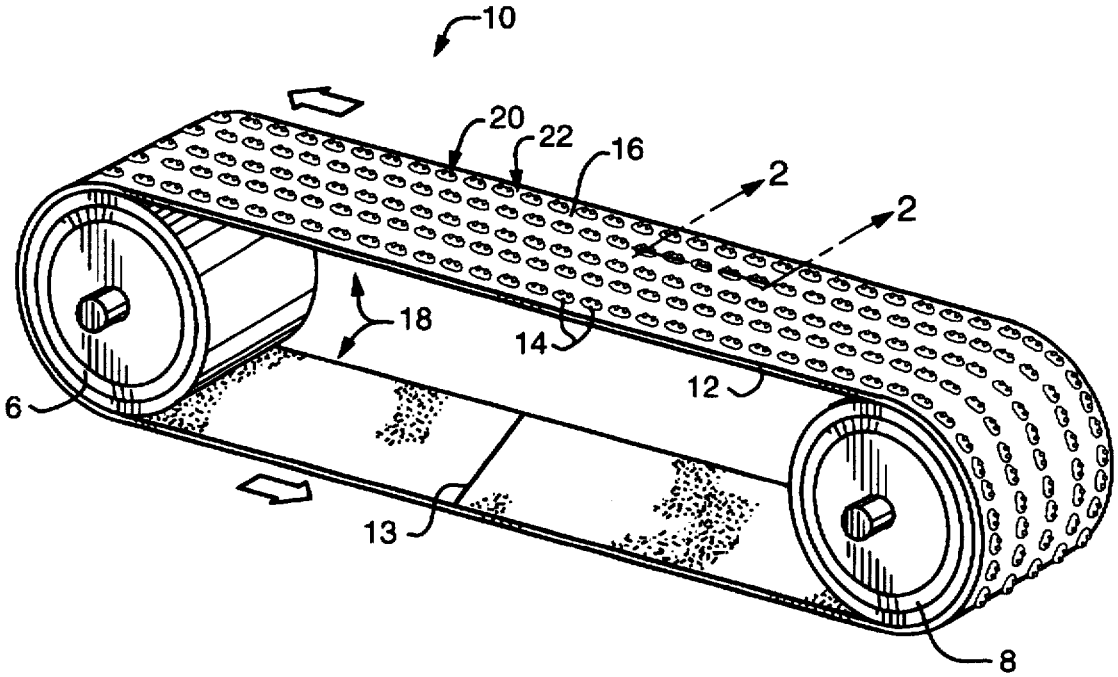
FIG. 1 is a perspective view of a metal abrasive belt according to the present invention, driven by pulleys.

A metal abrasive belt 10, FIG. 1, includes a continuous metal belt 12, such as a stainless steel belt, having a plurality of abrasive particles 14, such as diamond, Cubic Boron Nitride (CBN), or other similar particles, electroplated onto at least a portion of the continuous metal belt 12, as will be described in greater detail below. The metal abrasive belt 10 is used to perform an abrading process including, but not limited to, grinding, deburring, lapping, sanding, cutting and/or finishing any type of workpiece or product. The workpieces or products that can be abraded with the metal abrasive belt 10 can be made of various materials including, but not limited to, ferrous materials, non-ferrous materials, wood, ceramics, stone, glass, graphite, carbon, and fiberglass composites. The continuous metal belt 12 is preferably driven by one or more pulleys 6, 8, causing the abrasive particles 14 of the metal abrasive belt 10 to abrade a surface of the workpiece or product when the abrasive belt 10 is brought into contact with the surface of a workpiece.

The preferred continuous metal belt 12 is a substantially thin belt of high tensile strength alloys (e.g., up to about 280,000 psi) having low mass loading and low inertia. One example of such a continuous metal belt 12 is made from a strip of 300 series stainless steel having a thickness in the range of approximately 0.010"–0.020". A continuous metal belt 12 of this type has a number of desirable properties including, but not limited to, high strength properties, hardness, desired modulus of elasticity, long life, dimensional stability or consistency (i.e. resistance to camber and stretching), an ability to run at high speeds (e.g., approximately 4,000 RPM), high fatigue strength, durability, a high strength to weight ratio, a resistance to stretching (minimal elongation under tension), corrosion resistance and heat resistance (e.g., to approximately 400° F.). The present invention contemplates belts made of metals or conductive materials other than stainless steel that exhibit the desired properties.

According to one method of making the continuous metal belt 12, a strip of the desired metal, such as stainless steel, is welded, such as by laser welding, to form the continuous metal belt 12 having a welded seam 13 of high integrity. The width and length of the continuous metal belt 12 varies depending upon the desired application including belts in the range of at least ¼" wide with lengths of 6" to 200", although these sizes are not a limitation of the invention.

The continuous metal belt 12 includes an outer surface 16 and inner surface 18. The abrasive particles 14 are preferably electroplated onto the outer surface 16 to form a plurality of abrasive regions 20 having the abrasive particles 14, and non-abrasive regions 22 that are devoid of abrasive particles 14. The abrasive regions 20 and non-abrasive regions 22 can be arranged in any desired pattern on the continuous metal belt 12 depending upon the application.

Figure 2:
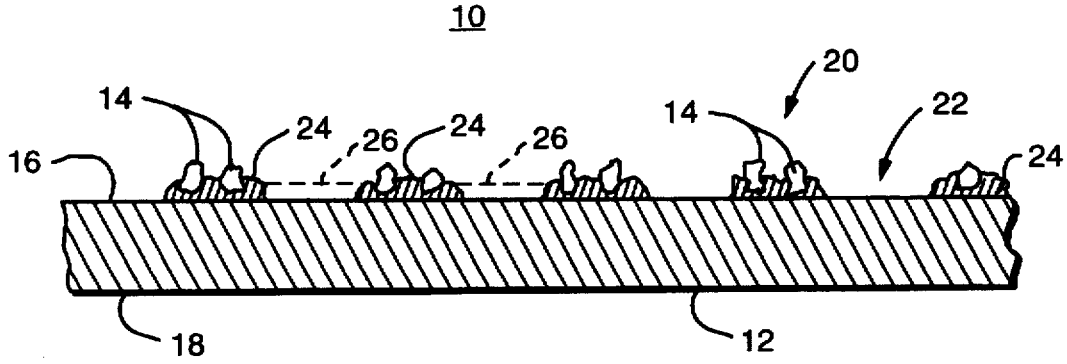
FIG. 2 is a side cross-sectional view of the metal abrasive belt taken at line II—II in FIG. 1.

According to the preferred embodiment, the abrasive particles 14, FIG. 2, are electroplated to the continuous metal belt 12 using an electroplating matrix 24 and procedure, such as a Nickel metal matrix, as well known in the art. The present invention also contemplates other electroplating matrices capable of being electrochemically bonded to a conductive substrate. The abrasive particles 14 are preferably made of a super abrasive material, such as diamond or Cubic Boron Nitride (CBN), and preferably range in grit sizes from approximately 20/30 to 400/600. The present invention also contemplates other grit sizes and abrasive materials including, but not limited to, aluminum oxide, silicon carbide, zirconia alumina and other similar abrasive materials.

The electroplating matrix 24 is preferably electrochemically deposited on at least a portion of the outer surface 16 of the continuous metal belt 12 in the presence of the abrasive particles 14. In one example, the continuous metal belt 12 is coated with the abrasive particles 14 suspended in the electroplating matrix. An electric current is then applied to the continuous metal belt 12 and electroplating matrix 24, for example, using an anode and cathode. The electric current causes the electroplating matrix 24 to partially surround the abrasive particles 14 and electrochemically bond the abrasive particles 14 to the continuous metal belt 12. The present invention contemplates any and all electroplating or electrochemical depositing processes known to those skilled in the art.

According to one method of the present invention, the abrasive regions 20 and non-abrasive regions 22 are selectively formed on the continuous metal belt 12, by, for example, masking the selected non-abrasive regions 22 on outer surface 16 of the continuous metal belt 12. For example, prior to depositing the electroplating matrix 24 on the continuous metal member 12, one or more non-conductive mask members 26 are disposed on the selected regions of the continuous metal member 12 that are to be non-abrasive regions 22. The mask members 26 prevent electrochemical deposition of the electroplating matrix 24, thereby forming non-abrasive regions 22 and abrasive regions 20 in the selected pattern on the outer surface 16 of the continuous metal belt 12. The inner surface 18 of the continuous metal belt 12 is also masked to prevent the electro-deposition of abrasive particles 14 on the inner surface 18. The present invention contemplates any masking technique known to those skilled in the art for use with an electroplating process.

The electroplating of the abrasive particles 14 directly to the continuous metal belt 12 provides a metal abrasive belt 10 that is more durable and rigid. The abrasive particles 14 are less likely to be worn off of the outer surface 16 of the continuous metal belt 12, and there are no layers of soft, flexible material that can easily come apart. The rigidity of the continuous metal belt 12 reduces camber and provides more consistency and precision in abrading a workpiece surface.

Figure 3:
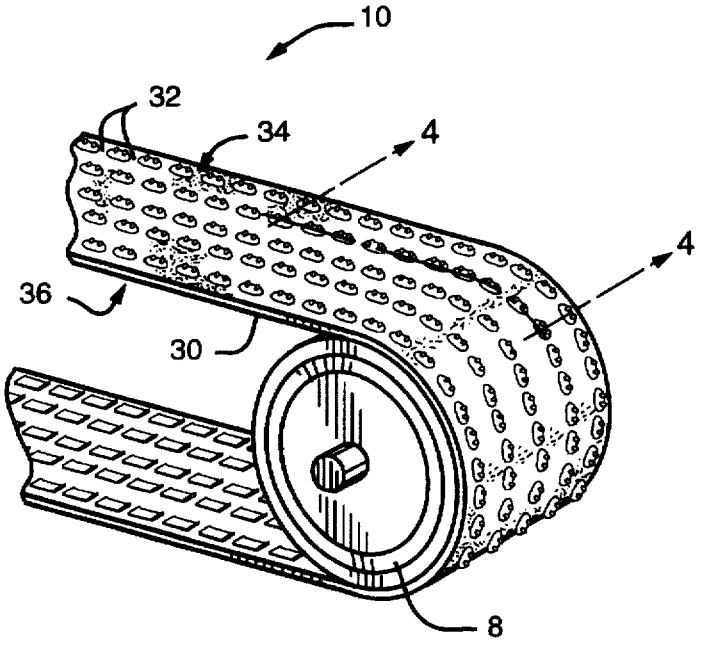
FIG. 3 is a partial perspective view of a metal abrasive belt having perforations, according to another embodiment of the present invention.

According to another embodiment, the abrasive belt 10, FIG. 3, includes a continuous metal belt 30 having one or more perforations 32 or regions of perforations extending from the outer surface 34 to the inner surface 36 of the continuous metal belt 30. This embodiment of the continuous metal belt 30 is preferably made by punching the perforations 32 in the strip of metal, such as stainless steel, and then welding the strip of metal to form the continuous metal belt 30. The perforations 32 can be formed either mechanically, for example, by punching through the continuous metal belt 30, or by a non-impact device, such as a laser.

Figure 4:
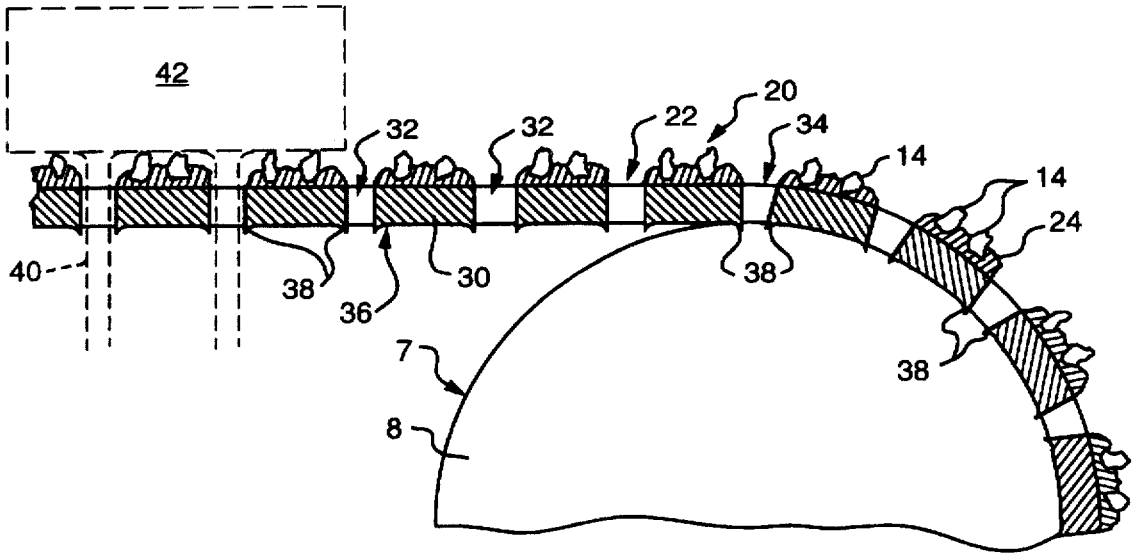
FIG. 4 is a partial side cross-sectional view of the metal abrasive belt having perforations taken at line IV—IV in FIG. 3.

The perforations 32, FIG. 4, act as a swarf clearing and discharge area, allowing the grinding residue or swarf 40 to be easily removed and expelled from the belt 10 while abrading a workpiece 42, thereby preventing or minimizing the build-up of swarf in the belt which impedes or prevents abrading and causes the belt to have to be removed and changed. The one or more perforations 32 also facilitate cooling during the abrasion process by allowing circulation of air or other types of cooling media through the continuous metal belt 30. The metal abrasive belt 10 having perforations 32 thereby allows material to be removed faster and reduces damage to both the belt and the workpiece caused by excessive heat, pressure and swarf during abrading.

This embodiment of the continuous metal belt 30 also preferably includes one or more burrs 38 formed at an intersection of each perforation 32 with the inner surface 36 of the continuous metal belt 30. These burrs 38 grip or bite into a surface 7 of each roller or pulley 8 to securely hold the continuous metal belt 30 to each pulley 8 to prevent the slipping of the belt 10 on the pulley 8.

The perforations 32 form the non-abrasive regions 22 and the regions of the outer surface 34 between the perforations 32 form the abrasive regions 20. The abrasive particles 14 are electroplated onto the regions between the perforation 32 of the continuous metal belt 30 with an electroplating matrix 24 according to the method described above. The inner surface 36 of the continuous metal belt 30 is preferably masked to prevent electro-deposition of abrasive particles 14 on the inner surface 36.

Accordingly, a metal abrasive belt according to the present invention provides a durable abrasive belt that resist wear and does not require frequent replacement. The metal abrasive belt is also rigid and resists stretching to provide a consistent surface finish and more precise abrasion of workpieces. The metal abrasive belt having perforations also allows material to be removed more quickly while facilitating cooling during the abrasion process.

Modifications and substitutions by one of ordinary skill in the art are considered to be within the scope of the present invention which is not to be limited except by the claims which follow.

What is claimed is:

1. A metal abrasive belt comprising:

a continuous metal belt having an outer surface and an inner surface; and a plurality of abrasive particles electroplated onto at least a portion of said outer surface of said continuous metal belt, said continuous metal belt including at least one perforation extending through said continuous metal belt from said outer surface to said inner surface of said continuous metal belt, said continuous metal belt further including at least one burr proximate an intersection of said at least one perforation and said inner surface of said continuous metal belt, for engaging with at least one pulley on which said continuous metal belt is driven.

2. The metal abrasive belt of claim 1 further including an electroplating matrix bonding said plurality of abrasive particles to said continuous metal belt.

3. The metal abrasive belt of claim 2 wherein said electroplating matrix includes a Nickel metal matrix.

4. The metal abrasive belt of claim 1 wherein said at least one perforation is so dimensioned to allow at least some amount of swarf from a workpiece to pass through said at least one perforation while abrading the workpiece.

5. The metal abrasive belt of claim 1 wherein said at least one perforation includes a plurality of perforations extending through said continuous metal belt from said outer surface to said inner surface of said continuous metal belt.

6. The metal abrasive belt of claim 5 wherein said plurality of abrasive particles are electroplated on abrasive regions on said outer surface of said continuous metal belt between said plurality of perforations.

7. The metal abrasive belt of claim 1 wherein said continuous metal belt includes stainless steel.

8. The metal abrasive belt of claim 1 wherein said continuous metal belt has a thickness in the range of about 0.010" to 0.020" inches.

9. The metal abrasive belt of claim 1 wherein said continuous metal belt is welded.

10. The metal abrasive belt of claim 1 wherein said continuous metal belt includes a plurality of abrasive regions and non-abrasive regions on said outer surface of said continuous metal belt, said abrasive regions having said plurality of abrasive particles and said non-abrasive regions being devoid of said plurality of abrasive particles.

11. The metal abrasive belt of claim 1 wherein said plurality of abrasive particles include abrasive materials selected from the group consisting of diamond and Cubic Boron Nitride (CBN).

12. A method of making a metal abrasive belt comprising a continuous metal belt and a plurality of abrasive particles, said method comprising the steps of:

forming said continuous metal belt having an outer surface and an inner surface, said step of forming said continuous metal belt further including forming at least one perforation through said continuous metal belt from said outer surface to said inner surface of said continuous metal belt, said perforation formed by punching said at least one perforation in said continuous metal belt, said step of punching forming at least one burr on said continuous metal belt at an intersection of said at least one perforation and said inner surface of said continuous metal belt; and electroplating said plurality of abrasive particles onto at least a portion of said outer surface of said continuous metal belt.

13. The method of claim 12 wherein said step of forming said continuous metal belt includes welding together first and second ends of a strip of metal material to form said continuous metal belt.

14. The method of claim 13 wherein said step of welding includes laser welding said first and second ends of said strip of material to form said continuous metal belt.

15. The method of claim 12 wherein said step of electroplating said plurality of abrasive particles onto at least a portion of said outer surface of said continuous metal belt includes electrochemically depositing an electroplating matrix on said at least a portion of said outer surface of said continuous metal belt in the presence of said plurality of abrasive particles.

16. The method of claim 15 wherein said step of electrochemically depositing said electroplating matrix includes:

coating said outer surface of said continuous metal belt with said plurality of abrasive particles suspended in said electroplating matrix; and applying an electric current to said continuous metal belt and said electroplating matrix deposited on said continuous metal belt such that said electroplating matrix partially surrounds and bonds said plurality of abrasive particles to said continuous metal belt.

17. The method of claim 12 wherein said step of electroplating said plurality of abrasive particles onto said at least a portion of said outer surface of said continuous metal belt includes electroplating said plurality of abrasive particles onto selected abrasive regions of said continuous metal belt.

18. The method of claim 16 further including the step of masking selected non-abrasive regions of said continuous metal belt prior to coating said outer surface of said continuous metal belt with said plurality of abrasive particles suspended in said electroplating matrix such that said electroplating matrix and said plurality of abrasive particles will not bond to said selected non-abrasive regions.

* * * * *